US011131171B2

(12) United States Patent
Burrafato et al.

(10) Patent No.: US 11,131,171 B2
(45) Date of Patent: Sep. 28, 2021

(54) TUBULAR PROTECTION FOR RADIOFREQUENCY SYSTEM TO IMPROVE THE RECOVERY OF HEAVY OILS

(71) Applicant: ENI S.P.A., Rome (IT)

(72) Inventors: Sebastiano Burrafato, Rome (IT); Alberto Maliardi, San Donato Milanese (IT); Domenico Di Renzo, Casirate d'Adda (IT)

(73) Assignee: ENI S.P.A., Rome (IT)

( * ) Notice: Subject to any disclaimer, the term of this patent is extended or adjusted under 35 U.S.C. 154(b) by 0 days.

(21) Appl. No.: 16/464,819

(22) PCT Filed: Dec. 1, 2017

(86) PCT No.: PCT/IB2017/057567
§ 371 (c)(1),
(2) Date: May 29, 2019

(87) PCT Pub. No.: WO2018/100545
PCT Pub. Date: Jun. 7, 2018

(65) Prior Publication Data

US 2019/0316453 A1 Oct. 17, 2019

(30) Foreign Application Priority Data

Dec. 2, 2016 (IT) ..... 102016000122488

(51) Int. Cl.
*E21B 43/24* (2006.01)
*E21B 36/04* (2006.01)
(Continued)

(52) U.S. Cl.
CPC ..... *E21B 43/2401* (2013.01); *E21B 36/003* (2013.01); *E21B 36/006* (2013.01);
(Continued)

(58) Field of Classification Search
CPC .... H01Q 13/203; H05B 6/62; H05B 2214/03; E21B 36/00; E21B 36/003; E21B 36/04; E21B 43/2401
See application file for complete search history.

(56) References Cited

U.S. PATENT DOCUMENTS 5,211,223 A * 5/1993 Mulville ..... E21B 36/04 166/60
9,016,367 B2 * 4/2015 Wright ..... F16L 39/005 166/248

(Continued)

FOREIGN PATENT DOCUMENTS

WO 2016/024197 A2 2/2016
WO WO-2016024197 A2 * 2/2016 ..... E21B 43/2401
WO WO-2017177319 A1 * 10/2017 ..... E21B 43/2401

OTHER PUBLICATIONS

Panther Lubricants, "Technical Learning—Thermal Expansion", http://www.pantherlubes.com/tl_6.html#:~:text=The%20values%20of%20the%20coefficient,%2D4%20%C2%B0C%2D1., 2004, 1 page (Year: 2004).*

(Continued)

*Primary Examiner* — Jennifer H Gay
(74) *Attorney, Agent, or Firm* — Husch Blackwell LLP

(57) ABSTRACT

The present invention relates to a system for facilitating the extraction of hydrocarbons. Tubular protection for an extraction system is provided using the RF heating of highly viscous hydrocarbons in situ by means of an antenna having a coaxial array of mode converters.

20 Claims, 3 Drawing Sheets

(51) Int. Cl.
*H01Q 13/20* (2006.01)
*H05B 6/62* (2006.01)
*E21B 36/00* (2006.01)

(52) U.S. Cl.
CPC ..... *E21B 36/04* (2013.01); *H01Q 13/203* (2013.01); *H05B 6/62* (2013.01)

(56) References Cited

U.S. PATENT DOCUMENTS 9,057,259 B2 * 6/2015 Dittmer ..... E21B 47/13
9,157,305 B2 * 10/2015 Dittmer ..... E21B 36/00
9,267,365 B2 * 2/2016 Dittmer ..... E21B 36/001
10,151,187 B1 * 12/2018 Wright ..... E21B 36/04
10,502,041 B2 * 12/2019 Wright ..... E21B 43/2401
10,577,905 B2 * 3/2020 Wright ..... H05B 6/62
10,577,906 B2 * 3/2020 Wright ..... E21B 43/24
10,662,747 B2 * 5/2020 Di Renzo ..... H01Q 13/203
2008/0265654 A1 10/2008 Kearl et al.
2012/0267095 A1 10/2012 Dreher et al.
2014/0216724 A1 * 8/2014 Dittmer ..... E21B 47/13 166/248
2014/0216725 A1 * 8/2014 Dittmer ..... E21B 43/2401 166/248
2014/0216726 A1 * 8/2014 Dittmer ..... E21B 36/001 166/248
2014/0262222 A1 * 9/2014 Wright ..... E21B 36/04 166/248
2015/0129223 A1 * 5/2015 Wright ..... E21B 17/10 166/302
2016/0160622 A1 * 6/2016 Trautman ..... E21B 36/04 166/302
2016/0329648 A1 * 11/2016 Dittmer ..... H01R 43/16
2017/0237145 A1 * 8/2017 Di Renzo ..... H01Q 13/203 166/60
2019/0048696 A1 * 2/2019 Apperley ..... H01Q 1/08
2019/0249528 A1 * 8/2019 Wright ..... E21B 43/2408
2019/0249529 A1 * 8/2019 Wright ..... H05B 6/80
2019/0249530 A1 * 8/2019 Wright ..... H05B 6/62
2019/0249531 A1 * 8/2019 Wright ..... H05B 6/62
2019/0316453 A1 * 10/2019 Burrafato ..... E21B 36/00

OTHER PUBLICATIONS

International Search Report and Written Opinion of Intl. Appln. No PCT/IB2017/057567 dated Mar. 14, 2018, 9 pages.

* cited by examiner

TUBULAR PROTECTION FOR RADIOFREQUENCY SYSTEM TO IMPROVE THE RECOVERY OF HEAVY OILS

TECHNICAL FIELD

The present invention relates to a system to aid extraction of hydrocarbons, in particular a tubular protection for an extraction system using RF heating of high-viscosity hydrocarbons in situ by means of an antenna comprising a coaxial array of mode converters.

KNOWN ART

International Patent Application WO2016/024197 by the same Applicant discloses a system comprising:

- a radiofrequency generator suitable for generating an electromagnetic signal; a coaxial transmission line connected to the generator and suitable for transmitting the signal along the drain, the coaxial line including an external conductor and an internal conductor which are separated by a layer of dielectric material;
- at least one mode converter which is positioned along the coaxial transmission line, in which the at least one mode converter interrupts the coaxial transmission line within the drain and comprises a first and a second conductor, the first conductor of the converter providing an electrical connection between the external conductor of the transmission line upstream of the converter and the external conductor of the transmission line downstream of the converter, and a second conductor of the mode converter providing an electrical connection between the internal conductor of the transmission line upstream of the mode converter and the internal conductor of the transmission line downstream of the converter,
- the at least one mode converter being suitable for providing, in the presence of an RF signal along the coaxial transmission line, a disturbance of the differential mode of propagation of the signal along the coaxial transmission line and for inducing a current in the external conductor of the coaxial transmission line and an electromagnetic field in the surrounding area which causes the hydrocarbons inside the reservoir to heat up.

According to a preferred embodiment, the system comprises a plurality of mode converters distributed along the coaxial transmission line inside the drain. In a preferred embodiment the plurality of mode converters comprises an array of mode converters located at regular intervals along the coaxial transmission line. In this description the term "disturbance" means that each mode converter radiates a fraction of the RF power propagating along the coaxial line by disturbing the differential propagation mode, causing radiation distributed along the array of mode converters.

The mode converters may be of the capacitive or inductive type and even a combination of both types. Inductive type converters cause the differential propagation mode of the signal along the coaxial transmission line to be disturbed by means of at least one inductive element. Capacitive converters cause the differential propagation mode of the signal along the coaxial transmission line to be disturbed by means of at least one capacitive element.

The system makes it possible to distribute RF radiation over long lengths of drain in horizontal, vertical or deviated oil wells.

This system makes possible an effective increase in the productivity of wells for the recovery of highly viscous hydrocarbons, in particular heavy oils, through its ability to heat the reservoir uniformly to moderate temperatures along the entire length of the drain. The use of RF for field applications using an antenna of considerable length gives rise to a serious problem of reliability over time if it is exposed to production fluids and heat and pressure cycles during operation of the well which can compromise the electrical insulation and thus give rise to deterioration of the system.

SCOPE OF THIS INVENTION

The solution to which this invention relates is intended to at least partly overcome the disadvantages of the known art.

GENERAL DESCRIPTION OF THE INVENTION

According to a first aspect of the present invention a system 10 for heating highly viscous hydrocarbons 22 in a reservoir 4 comprising at least one drain 6 is provided, the system 10 comprising:

- an antenna 14 connected to a radiofrequency generator 2 capable of generating an electromagnetic signal, the antenna 14 comprising: a coaxial transmission line 8 connected to the generator 2 and capable of transmitting the signal along the drain 6; at least one mode converter 12 positioned along the coaxial transmission line 8 within the drain 6, in which the at least one mode converter 12 interrupts the coaxial transmission line 8; the at least one mode converter 12 being capable of causing a disturbance in the differential mode of propagation of the signal along the coaxial transmission line 8 when a RF signal is present along the coaxial transmission line 8 and inducing an electromagnetic field in the surrounding area which causes the hydrocarbons 22 in the reservoir 4 to heat up;
- a tubular covering 16 of material which is transparent to electromagnetic waves, the tubular jacket 16 containing the antenna 14. Preferably the space between the tubular jacket 16 and the antenna 14 is filled with dielectric fluid 20.

The dielectric fluid preferably comprises a dielectric oil having a thermal expansion coefficient of less than 0.001 L/° C. Preferably the tubular jacket is of rigid material, for example glass fibre.

In a preferred embodiment of the present invention the tubular jacket comprises a volumetric compensator capable of taking up the greater volume of dielectric fluid once it expands because of the increased temperature. This volumetric compensator may comprise a cylindrical chamber placed at the extremity of the tubular jacket and separated from the tubular jacket by closure means arranged so as to open when the pressure of the dielectric field rises. Alternatively the volumetric compensator comprises a portion of variable volume arranged so as to increase in volume as a result of the increase in pressure of the dielectric fluid. In the latter case the variable volume portion may preferably comprise a telescopic chamber. In one embodiment the variable volume portion is separated from the tubular jacket by closure means arranged so as to open with an increase in the pressure of the dielectric fluid. In both the solutions described above the closure means preferably comprise a diaphragm having a breaking point corresponding to a predetermined pressure threshold, intended to break when the dielectric fluid reaches the determined pressure threshold.

By preventing contact with the well fluid, the system to which the present invention relates thus prevents possible problems with electrical isolation of the antenna, significantly improving reliability.

The system to which the present invention relates is capable of operating in a highly aggressive environment and, when provided with a volumetric compensator, of containing the expansion of the diathermic heavy oil within it. One of the advantages achieved through the present invention is its ability to protect the antenna from the production fluids, in particular when the antenna is of considerable length (e.g. longer than 400 m) and therefore exposed to higher risks associated with the reliability of the system over time.

BRIEF DESCRIPTION OF THE FIGURES

Reference will now be made to a set of figures to facilitate the description of some preferred embodiments of the present invention.

DETAILED DESCRIPTION OF A PREFERRED EMBODIMENT

Figure 1:
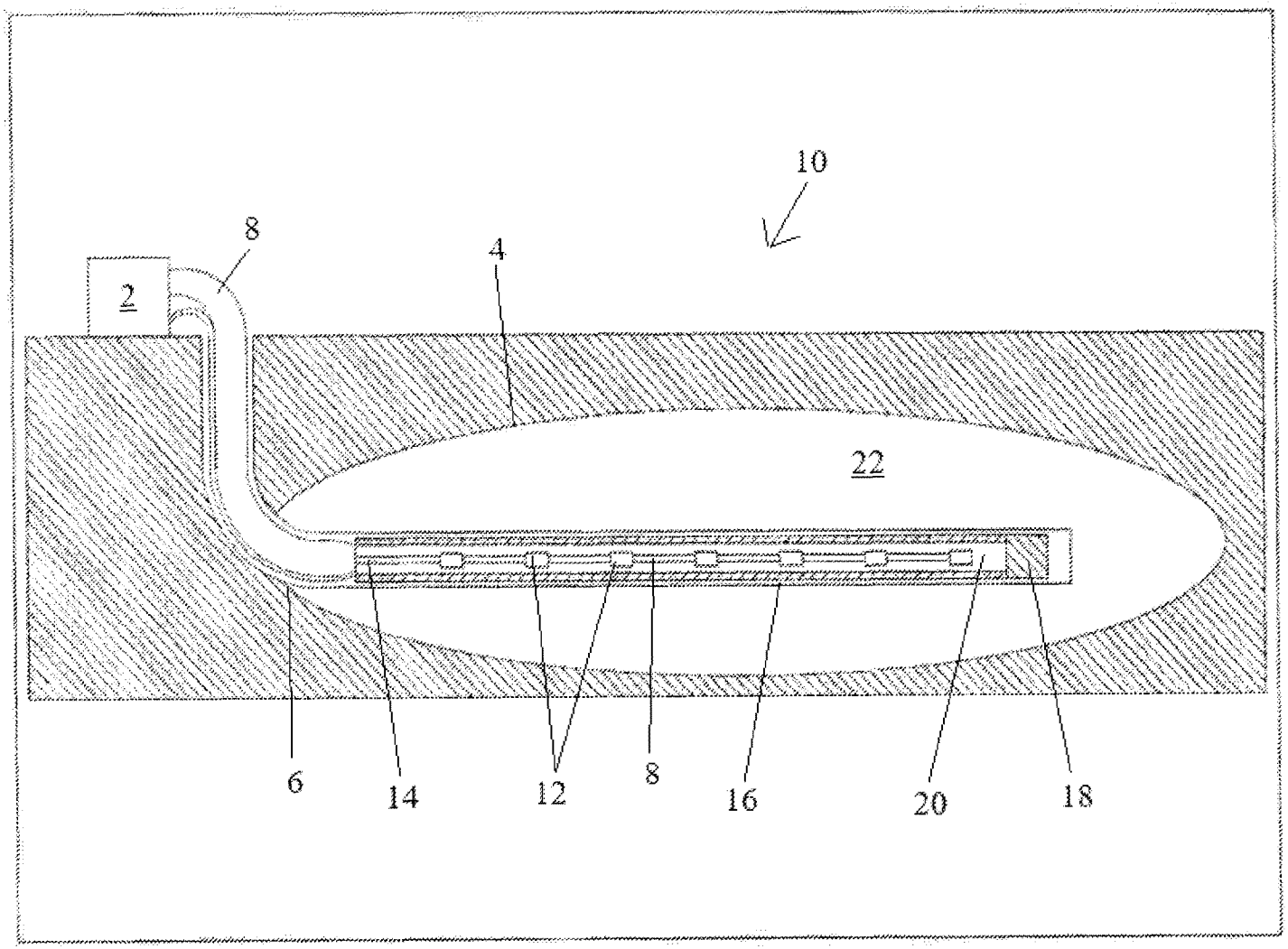
FIG. 1 illustrates the apparatus containing the axially located antenna to which a volumetric compensator is attached.
Figure 2:
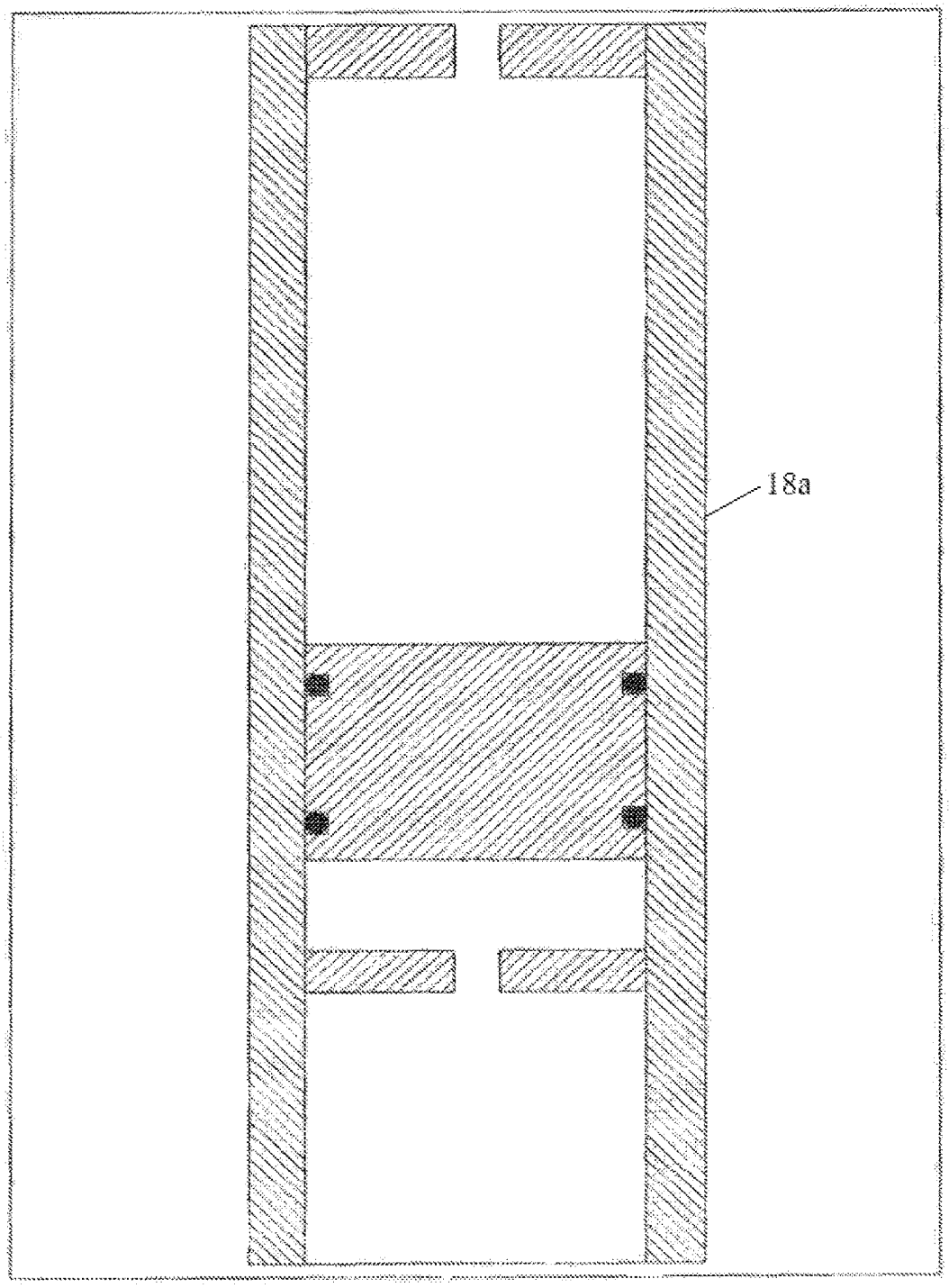
FIG. 2 shows the apparatus for antennas less than 400 metres long, to which a cylindrical volume compensator is attached.

The system 10 to which the present invention relates comprises a tube 16 of material which is transparent to the RF emissions from the antenna 14 for example glass fibre, containing the antenna arranged axially. According to a preferred embodiment of the present invention a volumetric compensator 18 is attached at its end. Other materials suitable for the tubular jacket 16 may be materials which are transparent to electromagnetic waves and have mechanical properties enabling them to be installed in a well. The dielectric fluid 20 (e.g. dielectric oil having a low thermal expansion coefficient) is exposed to a temperature rise when the antenna 14 is in operation and as a consequence an increase in volume. For this reason this system 10 is provided with a volumetric compensator 18 capable of containing the volume of expanded oil, taking into account the dimensional constraints enabling it to be lowered down a well and operate in the production zone.

According to a preferred embodiment of the present invention the volumetric compensator is initially isolated from the glass fibre tube by means of a diaphragm, for example a bursting disc, which prevents the dielectric oil from entering the compensator while it is descending down a well. According to a possible embodiment the bursting disc opens when the fluid pressure of the system exceeds a predetermined threshold value. At this point the expansion of the dielectric oil is contained within the volumetric compensator. As described in international patent application WO2016/024197 by the same Applicant, RF technology may be conveniently applied for example in horizontal wells up to 1000 metres long. Under these conditions it is particularly advantageous to cover the antenna with a tubular jacket such as that described in the present invention.

The function of such jacket is mainly that of isolating the antenna and the mode converters from the surrounding environment, comprising fluids (oil, methane gas and water) which over time can penetrate within the electrical components and give rise to short circuits. The dielectric oil contained in the tube in which the antenna is placed has the function of balancing out the pressure between the interior of the antenna container and the exterior, the well, where as a result of production dynamics the pressure can vary significantly. The oil together with the expansion chamber and any corresponding piston makes it possible to maintain a balance between the pressures inside and outside the container thus preventing production fluids from entering within the container even when the radiofrequency system is switched off, with a rising outside pressure and an internal pressure decreasing because the dielectric oil is cooling.

According to a preferred embodiment of the present invention the space between the antenna and the tubular jacket is filled with a fluid which has insulating properties in order to prevent short circuits between the antenna and the mode converters. According to a preferred embodiment this fluid is a dielectric oil having a low thermal expansion coefficient. As an alternative any dielectric fluid may be used provided that it succeeds in providing an expansion chamber which is suitable for the temperature difference created by the radiofrequency system when it is in operation.

When the antenna is in operation a considerable quantity of heat is generated and this causes the dielectric fluid to expand. This expansion obviously brings about an increase in volume which therefore has to be compensated for. In other words it is necessary to provide a variable volume (or better a capacity within the container) capable of accommodating the increased volume of dielectric fluid.

According to a preferred embodiment of the present invention which is particularly suitable in cases where the antenna 14 is not more than 400 m long, a fixed cylindrical space 18*a* is provided at the extremity of the tubular sheath 16.

As an alternative, in particular for antennas 14 more than 400 m long, a telescopic volumetric compensator 18*b* is provided, the additional capacity of which varies as the volume of heated dielectric fluid varies so that the inside and outside pressures are always balanced.

For operative installation of the antenna with the corresponding protection, one solution according to a preferred embodiment of the present invention comprises running the container tube down the well. Subsequently the antenna is lowered within the container, and then the whole is filled with dielectric oil. The last stage is that of installing the "lid" which closes off the container and allows the supply cable to pass through and therefore to be carried to the surface together with the production tube in order to power the antenna.

This general procedure will be optimised/modified according to the well, the length of the antenna and other operating factors. In fact when the antenna has to be significantly long, such that it is not able to support its own weight when it is suspended in the vertical part of the well, suspension systems anchored to the container tube must be provided in order to take up the weight of the antenna, which is itself in sections.

In each of the two embodiments of the volumetric compensator described above provision must be made for the additive capacity offered by the compensator to be separate from the main capacity of the sheath during the stage of installing the antenna and the protective sheath. This is because at the installation temperature the dielectric fluid which is poured in in accordance with the procedure described above will have a minimum volume and its quantity must be substantially commensurate with the basic capacity of the tubular sheath (that is without considering the additional capacity of the compensator). The capacity of the compensator will only come into play when the dielectric fluid is heated through operation of the antenna.

According to a preferred embodiment of the present invention a diaphragm separating the tubular sheath from the compensator is provided. This diaphragm may for example comprise a gauged metal disc which breaks at the desired pressure. The breaking pressure will depend on the breaking pressure of the container itself: the properties of the diaphragm will cause it to break as a result of the pressure exerted by expansion of the dielectric fluid once it is heated. In this way the increased volume of dielectric fluid finds the necessary outlet.

The antenna and the entire system comprising the container to which this invention relates will be dimensioned on the basis of the characteristics of the well and the fluids which will be produced. The internal diameter of the container will be dimensioned on the basis of the diameter of the antenna and the space between the antenna and the container. The antenna diameter may vary on the basis of the electrical power required according to the length of the drain in the reservoir and the temperature which it is desired to achieve in order to produce the heavy oils.

Figure 3:
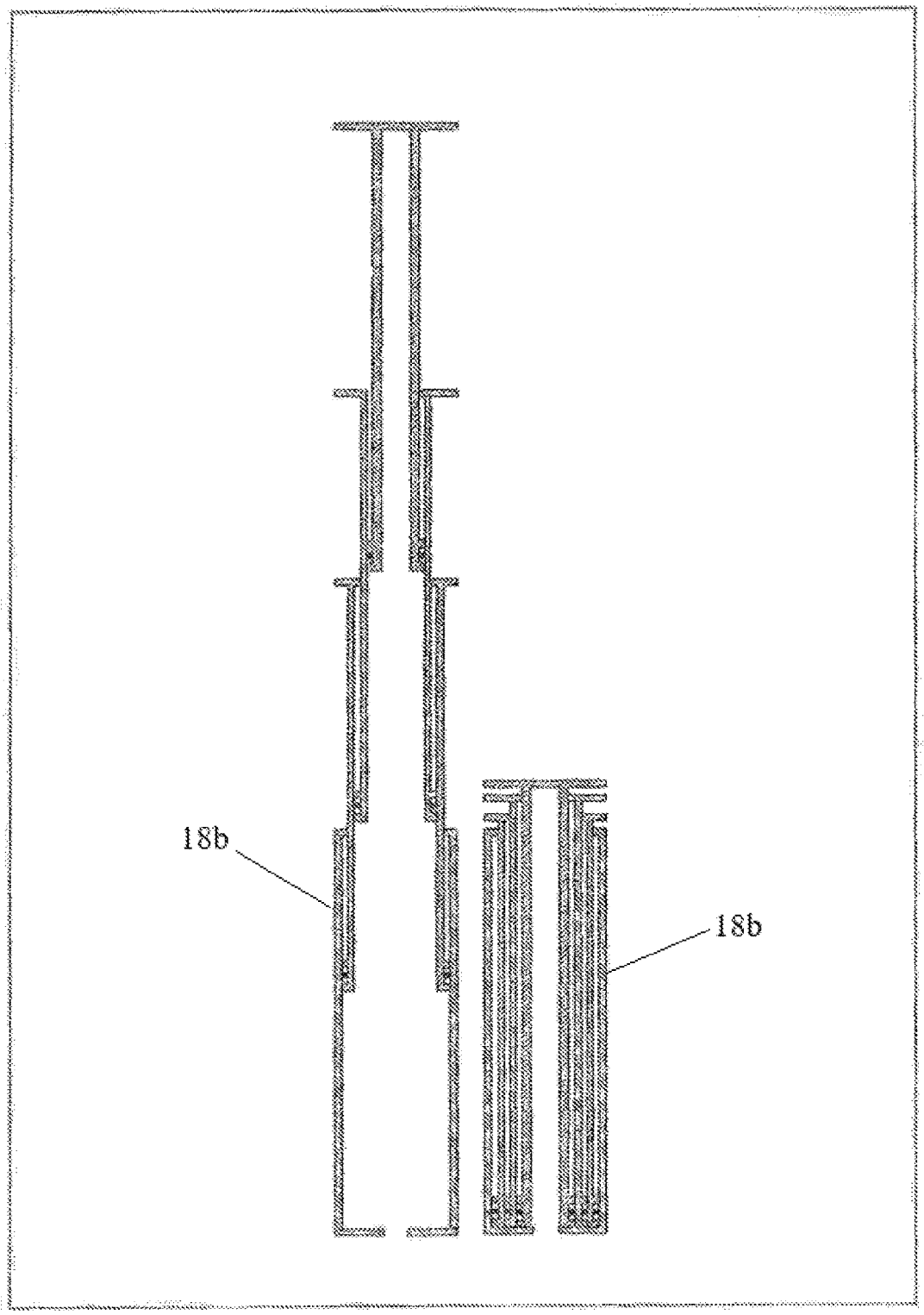
FIG. 3 shows the apparatus for antennas more than 400 metres long, to which a three-stage telescopic compensator is attached.

In the case of an antenna between 400 and 1000 metres long and a horizontal production drain diameter of 0.15 m it is possible to have an expansion volume of between 80 and 200 litres. Under these conditions the telescopic cylinder volumetric compensator may be used (see FIG. 3). The latter should have a length of 7 metres in the closed position and a maximum length of 28 metres when opened up, the outside diameter of the first tube being 0.11 m and the other tubes of decreasing diameter as required by the telescopic dimensioning.

The antenna and the corresponding components will be installed within the container using procedures which may vary depending upon the length of the antenna itself and the characteristics of the well in which the entire radiofrequency system will be installed.

The typical procedure will be to lower the container with the system allowing expansion of the dielectric fluid, insert the antenna within the container tube, fill the system with dielectric fluid and then insert the lid which allows the power cable for the antenna to leave.

The entire apparatus will be run down the well using the following procedure: the expansion system with the bursting disc which prevents the dielectric oil from entering the suitably installed compensator will be lowered down the well, after which the entire length of the glass fibre antenna container will be lowered.

When the last element of the antenna container is in the well the entire length of the antenna will be lowered, making any joints between the various components if necessary. Subsequently the "lid" will be electrically and mechanically connected to the antenna, and will subsequently be screwed onto the container tube.

The system, the container tube with the inserted antenna, will be filled completely with dielectric fluid and then the "lid" with the passage for the power cable connected to the antenna will be installed on the container tube.

The entire system can be run down the well.

When the length of the antenna has to be significantly long, such that it is unable to support its own weight when it is suspended in the vertical portion of the well, there will be a ned to provide suspension systems which when anchored to the container tube make it possible to offload the weight of the antenna, which is itself in sections. The components making it possible to install the antenna in sections must support the weight of the antenna above, and must be pierced to allow for thermal expansion of the dielectric fluid of the entire system.

The invention claimed is:

1. A system for heating high viscosity hydrocarbons in a reservoir, the reservoir comprising at least one drain, the system comprising:

an antenna connected to a radio frequency generator capable of generating an electromagnetic signal, the antenna comprising: a coaxial transmission line connected to the generator and capable of transmitting the signal along the drain; at least one mode converter positioned along the coaxial transmission line inside the drain, in which the at least one mode converter interrupts the coaxial transmission line; the at least one mode converter being able, when an RF signal is present along the coaxial transmission line, to produce a disturbance in the differential mode of propagation of the signal along the coaxial transmission line and to induce an electromagnetic field in the surrounding space which causes the hydrocarbons within the reservoir to be heated;

a tubular jacket of material transparent to electromagnetic waves, the tubular jacket containing the whole antenna and being filled with a dielectric fluid, the tubular jacket further comprising a volumetric compensator capable of accommodating an increased volume of the dielectric fluid when the dielectric fluid expands due to an increased temperature.

2. System according to claim 1, wherein the dielectric fluid comprises a dielectric oil with a thermal expansion coefficient of from 0 to less than 0.001 L/° C.

3. System according to claim 1 wherein the tubular jacket is rigid.

4. System according to claim 3 wherein the material transparent to electromagnetic waves comprises fibreglass.

5. System according to claim 1 wherein the volumetric compensator comprises a cylindrical chamber on the end of the tubular jacket and separate from the tubular jacket by closing means arranged to open with increasing pressure of the dielectric fluid.

6. System according to claim 5 wherein the closing means comprise a diaphragm having a breaking point corresponding to a predetermined pressure threshold, arranged to rupture when the dielectric fluid reaches the determined pressure threshold.

7. System according to claim 1 wherein the volumetric compensator comprises a variable volume portion arranged to increase in volume as a result of the increasing pressure of the dielectric liquid.

8. System according to claim 7 wherein the variable volume portion comprises a telescoping chamber.

9. System according to claim 8 wherein the variable volume portion is separated from the tubular jacket by closing means arranged to open with increasing pressure of dielectric fluid.

10. System according to claim 9 wherein the closing means comprise a diaphragm having a breaking point corresponding to a predetermined pressure threshold, arranged to rupture when the dielectric fluid reaches the determined pressure threshold.

11. System according to claim 7 wherein the variable volume portion is separated from the tubular jacket by closing means arranged to open with increasing pressure of the dielectric fluid.

12. System according to claim 11 wherein the closing means comprise a diaphragm having a breaking point corresponding to a predetermined pressure threshold, arranged to rupture when the dielectric fluid reaches the determined pressure threshold.

13. A system for heating high viscosity hydrocarbons in a reservoir, the reservoir comprising at least one drain, the system comprising:

an antenna connected to a radio frequency generator capable of generating an electromagnetic signal, the antenna comprising: a coaxial transmission line connected to the generator and capable of transmitting the signal along the drain; at least one mode converter positioned along the coaxial transmission line inside the drain, in which the at least one mode converter interrupts the coaxial transmission line; the at least one mode converter being able, when an RF signal is present along the coaxial transmission line, to produce a disturbance in the differential mode of propagation of the signal along the coaxial transmission line and to induce an electromagnetic field in the surrounding space which causes the hydrocarbons within the reservoir to be heated;

a tubular jacket of material transparent to electromagnetic waves, the tubular jacket containing the antenna and being filled with a dielectric fluid, the tubular jacket further comprising a volumetric compensator capable of accommodating an increased volume of the dielectric fluid when the dielectric fluid expands due to an increased temperature, wherein the volumetric compensator comprises a cylindrical chamber on the end of the tubular jacket and separate from the tubular jacket by closing means arranged to open with increasing pressure of the dielectric fluid.

14. System according to claim 13 wherein the closing means comprise a diaphragm having a breaking point corresponding to a predetermined pressure threshold, arranged to rupture when the dielectric fluid reaches the predetermined pressure threshold.

15. A system for heating high viscosity hydrocarbons in a reservoir, the reservoir comprising at least one drain, the system comprising:

an antenna connected to a radio frequency generator capable of generating an electromagnetic signal, the antenna comprising: a coaxial transmission line connected to the generator and capable of transmitting the signal along the drain; at least one mode converter positioned along the coaxial transmission line inside the drain, in which the at least one mode converter interrupts the coaxial transmission line; the at least one mode converter being able, when an RF signal is present along the coaxial transmission line, to produce a disturbance in the differential mode of propagation of the signal along the coaxial transmission line and to induce an electromagnetic field in the surrounding space which causes the hydrocarbons within the reservoir to be heated;

a tubular jacket of material transparent to electromagnetic waves, the tubular jacket containing the antenna and being filled with a dielectric fluid, the tubular jacket further comprising a volumetric compensator capable of accommodating an increased volume of the dielectric fluid when the dielectric fluid expands due to an increased temperature, wherein the volumetric compensator comprises a variable volume portion arranged to increase in volume as a result of the increasing pressure of the dielectric liquid.

16. System according to claim 15 wherein the variable volume portion comprises a telescoping chamber.

17. System according to claim 16 wherein the variable volume portion is separated from the tubular jacket by closing means arranged to open with increasing pressure of dielectric fluid.

18. System according to claim 17 wherein the closing means comprise a diaphragm having a breaking point corresponding to a predetermined pressure threshold, arranged to rupture when the dielectric fluid reaches the determined pressure threshold.

19. System according to claim 15 wherein the variable volume portion is separated from the tubular jacket by closing means arranged to open with increasing pressure of the dielectric fluid.

20. System according to claim 19 wherein the closing means comprise a diaphragm having a breaking point corresponding to a predetermined pressure threshold, arranged to rupture when the dielectric fluid reaches the determined pressure threshold.

* * * * *